US008827732B2

(12) United States Patent
Lin et al.

(10) Patent No.: US 8,827,732 B2
(45) Date of Patent: Sep. 9, 2014

(54) FLEXIBLE CIRCUIT BOARD CONNECTOR

(71) Applicant: Taiwan Suncagey Industrial Co., Ltd., New Taipei (TW)

(72) Inventors: Sung-Tien Lin, New Taipei (TW); Yen-Hsun Chen, New Taipei (TW); Hsuan-Fu Huang, New Taipei (TW)

(73) Assignee: Taiwan Suncagey Industrial Co., Ltd., New Taipei (TW)

( * ) Notice: Subject to any disclaimer, the term of this patent is extended or adjusted under 35 U.S.C. 154(b) by 70 days.

(21) Appl. No.: 13/633,897

(22) Filed: Oct. 3, 2012

(65) Prior Publication Data

US 2014/0094047 A1 Apr. 3, 2014

(51) Int. Cl.
*H01R 13/15* (2006.01)

(52) U.S. Cl.
USPC ..... 439/260

(58) Field of Classification Search
CPC ..... H01R 12/79; H01R 23/684
USPC ..... 439/260, 495
See application file for complete search history.

(56) References Cited

U.S. PATENT DOCUMENTS

| | | | | |
|---|---|---|---|---|
| 7,601,017 | B2 * | 10/2009 | Wang et al. | 439/260 |
| 8,641,439 | B2 * | 2/2014 | Tateishi et al. | 439/260 |
| 2007/0032115 | A1 * | 2/2007 | Takashita | 439/260 |
| 2007/0087605 | A1 * | 4/2007 | Suzuki et al. | 439/260 |
| 2011/0171844 | A1 * | 7/2011 | Chen | 439/260 |

* cited by examiner

*Primary Examiner* — Phuong Dinh
(74) *Attorney, Agent, or Firm* — Cheng-Ju Chiang

(57) ABSTRACT

A flexible circuit board connector includes a dielectric housing having receiving slots for receiving terminals. Each of the terminals includes first and second contact arms, a biasing arm, a fixing arm, and a linking arm. A pressing element pivots on the fixing arm against the biasing arm so as to tilt the first contact arm towards the second contact arm to clamp a flexible circuit board, wherein each of the receiving slots is formed with a retention wall, each of the terminals includes a first engaging portion formed on the junction of the first contact arm and the biasing arm or on the junction of the second contact arm and the fixing arm, the first engaging portion is located in alignment with an axis of the linking arm, whereby the terminal is secured in the receiving slot by the first engaging portion and the retention wall.

6 Claims, 2 Drawing Sheets

FLEXIBLE CIRCUIT BOARD CONNECTOR

BACKGROUND OF THE INVENTION

1. Field of the Invention

The present invention relates to a flexible circuit board connector, and particularly to a terminal which is configured to be securely mounted in a connector having a thin-type structure so as to prevent the terminal from being coming off a dielectric house and therefore provide a stable transmission of electronic signals or data.

2. Related Art

A conventional connector for a flexible circuit board includes multiple terminals mounted in a dielectric housing. Each terminal has a first contact arm and a second contact arm for clamping the flexible circuit board, a driving arm and a soldering arm respectively connecting the first and second contact arms at ends thereof, and a support arm disposed among and connecting with the first and second contact arms and the driving and soldering arms, wherein the first and second arms and the support arm cooperatively form a clamping opening. The driving arm is disposed at a rear portion of the connector and is capable of being driven by a pressing element rotatably supported by the connector so as to tilt the first contact towards the second contact arm such that the first contact arm and the driving arm are operated as a lever, whereby the first and second contact arms narrow the clamping opening in order to clamp the flexible circuit board therebetween.

The terminals are mounted in the dielectric housing with the first and second contact arms in contact with an interfering element of the dielectric housing in order to prevent disengagement from the dielectric housing. The interfering element is located with respect to the clamping opening and on the way where the flexible circuit board is being inserted. As a result, the overall thickness of the dielectric housing has to be increased to allow the insertion of the flexible circuit board. However, a connector of large thickness does not keep up with the trend toward thin-type structure for most applied electronic products. Although the terminals can be produced and assembled with the connector through the insert molding technology, the cost for insert molding is rather high and the manufacturing process thereof is limited as well. Hence it is imperative to improve the structure of the connector for a flexible circuit board to meet the requirements for thin-type assembly.

SUMMARY OF THE INVENTION

Accordingly, an object of the present invention is to provide a flexible circuit board connector having a plurality of terminals which are fixed in a dielectric housing not only by being soldered onto a printed circuit board but also by an auxiliary position structure to allow the terminals to be securely mounted in a dielectric housing of a thin-type structure without concerns of being coming off or disengaged from the dielectric housing, whereby providing a stable transmission of electronic signals and data.

To achieve the above-mentioned object, the electrical connector comprises a dielectric housing defining a mating end and a connecting end, a plurality of receiving slots formed in the dielectric housing. A plurality of terminals are mounted in the corresponding receiving slots from the connecting end to the mating end. Each of the terminals comprises a first contact arm and a second contact arm disposed in opposition to the first contact arm, the first and second contact arms respectively having contact portions. A biasing arm and a fixing arm respectively integrally connect with ends of the first and second contact arms. A linking arm is disposed between and connected to a junction of the first contact arm and the biasing arm and a junction of the second contact arm and the fixing arm. A pressing element rotatably is supported by the dielectric housing and pivoting on the fixing arm against the biasing arm so as to tilt the first contact arm towards the second contact arm to clamp a flexible circuit board in place; wherein each of the receiving slots is formed with a retention wall projecting outward of an inner wall of the receiving slot, each of the terminals comprises a first engaging portion formed on the junction of the first contact arm and the biasing arm or on the junction of the second contact arm and the fixing arm, wherein the first engaging portion is located in alignment with an axis of the linking arm.

With the above-mentioned structure, the terminal is being jammed against the receiving slot by the first engaging portion and the retention wall at the time when the first engaging portion travels over the retention wall so as to prevent the terminal from being disengaged in a direction of the insertion of the terminal.

According to an embodiment of this invention, the first engaging portion is integrally formed on the junction of the first contact arm and the biasing arm, and projects upwards from the first contact arm.

According to another embodiment of this invention, a second engaging portion is formed opposite to the first engaging portion on the junction of the second contact arm and the fixing arm for further securing the terminal in the receiving slot.

According to another embodiment of this invention, the second engaging portion projects downwards from the second contact arm to form a barb for being engaged with the retention wall so as to prevent the terminal from being disengaged in a direction of the insertion of the terminal.

DESCRIPTION OF THE PREFERRED EMBODIMENTS

Figure 1:
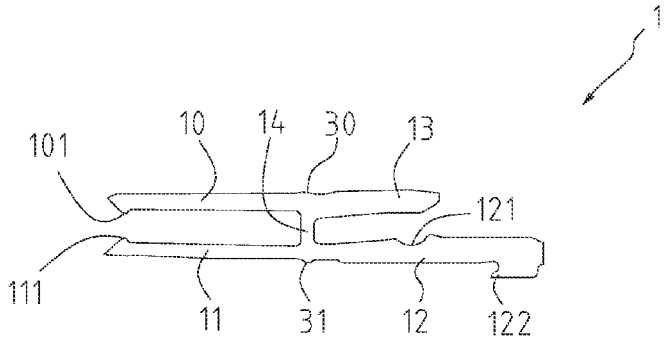
FIG. 1 is a right side elevational view of a terminal of a flexible circuit board connector of the present invention.
Figure 2:
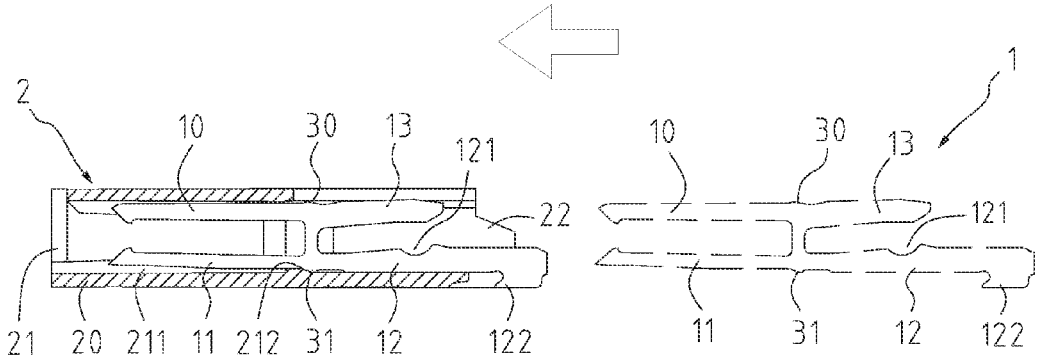
FIG. 2 is a schematic view showing the terminal of FIG. 1 is to be mounted in a dielectric housing of the flexible circuit board connector.

Referring to FIGS. 1 and 2, a flexible circuit board connector 2 of the present invention comprises a dielectric housing 20 and a plurality of terminals 1 mounted therein. The dielectric housing 20 defines a mating end 21 at a front thereof and a connecting end 22 at a rear thereof, a plurality of receiving slots 211 are formed and arranged in the dielectric housing 20 and pass through the connecting end 22 and the mating end 21. Each of the receiving slots 211 is formed with a retention wall 212 projecting outward of an inner wall of the receiving slot 211, a pressing element 201 (referring to FIG. 3) is rotatably supported at the connecting end 22 of the dielectric housing 20, and the pressing element 201 is provided with a cam shaft 202.

Each of the terminals 1 comprises a first contact arm 10, a second contact arm 11, a fixing arm 12, and a biasing arm 13, and a linking arm 14, wherein the second contact arm 11 is disposed in opposition to and below the first contact arm 10, the first and second contact arms 10, 11 respectively having contact portions 101, 111 at front ends thereof for electrically contacting a flexible circuit board (not shown).

The biasing arm 13 and the fixing arm 12 respectively integrally connect with the first and second contact arms 10, 11 in a way such that the biasing arm 13 and the fixing arm 12 are disposed in a right part of the receiving slot 211 and the first and second contact arms 10, 11 are disposed in a left part of the receiving slot 211. The fixing arm 12 is intended to be soldered to a printed circuit board (not shown), and has a pivoting slot 121 formed thereon and disposed under the biasing arm 13 for enabling the cam shaft 202 of the pressing element 201 to pivot thereon (shown in FIG. 3). The fixing arm 12 further has a fixing leg 122 shaped as a barb to be hooked onto a rear side of the dielectric housing 21 at the connecting end 22. Moreover, the first contact arm 10 and the second contact arm 11 slightly incline toward each other and therefore respectively remain a slight gap with inner walls of the receiving slot 211.

Figure 3:
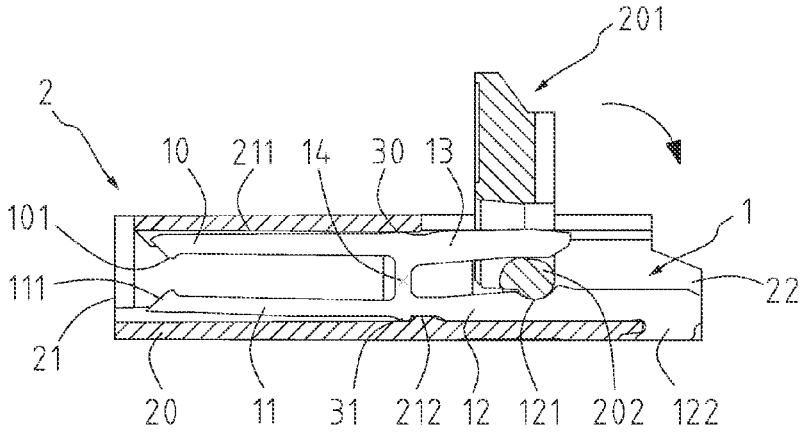
FIG. 3 is a schematic cutaway side view of the flexible circuit board connector being assembled.
Figure 4:
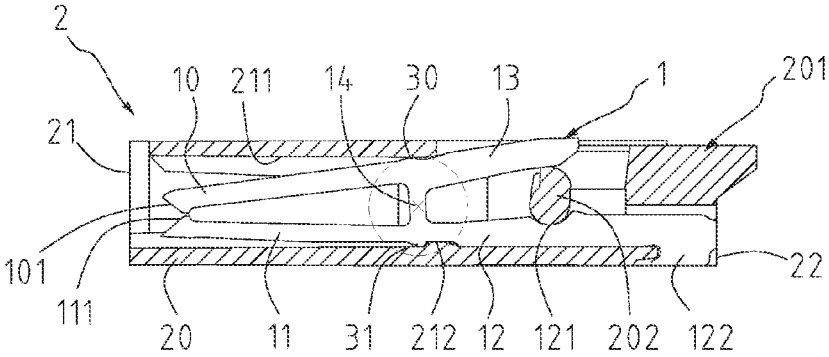
FIGS. 4 and 5 are schematic views respectively showing the terminal that is being pressed by a pressing element to function as a clamp.

The biasing arm 13 integrally connects with the first contact arm 10 such that an upper surface of the biasing arm 13 is slightly higher than an upper surface of the first contact arm 10 in the receiving slot 211. An end portion of the biasing arm 13 is disposed on and abuts against the cam shaft 202 in order to be tilted upwards and downwards by the rotation of the pressing element 201 (as shown in FIGS. 3 and 4), with the linking arm 14 functioned as a fulcrum. As result, the first contact arm 10 is tilted upwards and downwards in conjunction with the biasing arm 13.

The linking arm 14 is disposed between and connected to a junction of the first contact arm 10 and the biasing arm 13 and a junction of the second contact arm 11 and the fixing arm 12. As described above, once the biasing arm 13 is driven by the pressing element 201, the linking arm 14 is functioned as a fulcrum and slightly inclines toward the mating end 21, and the first contact arm 10 is being tilted towards the second contact arm 11, whereby the first and second contact arms 10, 11 are operated as a clamp.

In particular, each of the terminals 1 comprises a first engaging portion 30 and a second engaging portion 31 located in opposition to the first engaging portion 30 about the linking arm 14, wherein the first engaging portion 30 is formed on and projects upwards from the junction of the first contact arm 10 and the biasing arm 13, while the second engaging portion 31 is formed on and projects downwards from the junction of the second contact arm 11 and the fixing arm 12 and has a barb-shape. A recessed portion (not labeled) is formed on the fixing arm 12 adjacent to the second engaging portion 31. The retention wall 212 is disposed opposite to the first engaging portion 30. Both the first and second engaging portions 30, 31 are located in alignment with an axis of the linking arm 14. In assembly, when the terminal 1 is inserted into the receiving slot 211 from the connecting end 22 to the mating end 21, the second engaging portion 31 moves towards the retention wall 212 (as shown in FIG. 2) and then pass along it to be engaged with the retention wall 212 which is received in the recessed portion. At the time when the first engaging portion 30 travels over the retention wall 212, the first engaging portion 30 is tightly abutted against an upper wall of the housing 20 (as shown in FIG. 3), and thus produces a pressing force towards the second engaging portion 31. As a result, the terminal 1 is capable of being secured in place in the receiving slot 211, and is further retained in the receiving slot 211 by the engagement of the second engaging portion 31 and the retention wall 212. Therefore, the terminal 1 is not likely to be affected by the operation of the biasing arm 46 to be disengaged from the dielectric housing 20 in a direction of the insertion of the terminal 1 (as shown in FIG. 3).

Figure 5:
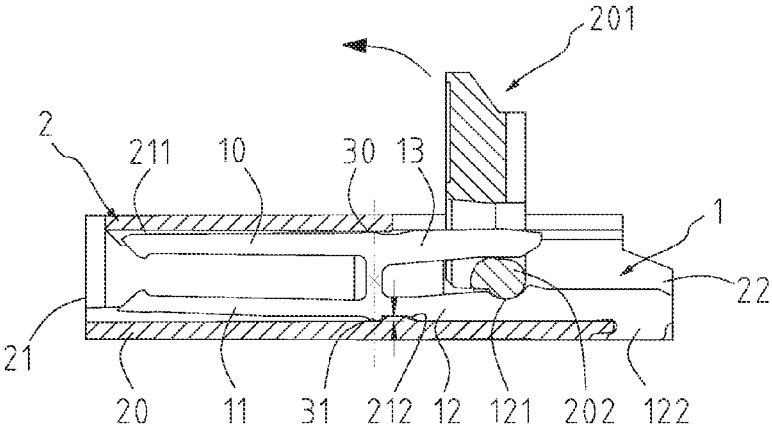

Continuously referring to FIGS. 3 to 5, when the cam shaft 202 of the pressing element 201 pivots on the pivoting slot 121 against the biasing arm 13, the biasing arm 13 is thus being tilted upwards or downwards and drives the first contact arm 10 to move towards or away the second contact arm 11 in order to clamp or release a flexible circuit board (not shown). In this manner, the first and second engaging portions 30, 31 and the retention wall 212 are utilized to withstand the force from the rotation of the pressing element 201 so as to ensure a securely engagement of the terminal 1 and the receiving slot 211 and provide a stable transmission of electronic signals and data.

It is understood that the invention may be embodied in other forms within the scope of the claims. Thus the present examples and embodiments are to be considered in all respects as illustrative, and not restrictive, of the invention defined by the claims.

What is claimed is:

1. A flexible circuit board connector, comprising:

a dielectric housing defining a mating end and a connecting end opposite to the mating end, a plurality of receiving slots formed in the dielectric housing and passing through the connecting end and the mating end;

a plurality of terminals mounted in the corresponding receiving slots from the connecting end to the mating end, each of the terminals comprising:

a first contact arm and a second contact arm disposed in opposition to the first contact arm, the first and second contact arms respectively having contact portions;

a biasing arm and a fixing arm respectively integrally connecting with ends of the first and second contact arms, the fixing arm having a fixing leg and a pivoting slot; and a linking arm disposed between and connected to a junction of the first contact arm and the biasing arm and a junction of the second contact arm and the fixing arm; and a pressing element rotatably supported by the dielectric housing, and pivoting on the pivoting slot against the biasing arm so as to tilt the first contact arm towards the second contact arm to clamp a flexible circuit board in place;

wherein each of the receiving slots is formed with a retention wall projecting outward of an inner wall of the receiving slot, each of the terminals comprises a first engaging portion formed on the junction of the first contact arm and the biasing arm and a second engaging portion formed on the junction of the second contact arm and the fixing arm, wherein the first engaging portion and the second engaging portion are located in alignment with an axis of the linking arm, and the terminal is being jammed against the receiving slot by the first engaging portion, the second engaging portion and the retention wall at the time when the second engaging portion travels over the retention wall so as to prevent the terminal from being disengaged in a direction of the insertion of the terminal;

wherein the first engaging portion is formed on and projects upwards from the junction of the first contact arm and the biasing arm for securing the terminal in the receiving slot, and the second engaging portion is formed opposite to the first engaging portion on and projects downwards from the junction of the second contact arm and the fixing arm for further securing the terminal in the receiving slot.

2. The flexible circuit board connector of claim 1, wherein the first engaging portion is integrally formed on and projects upwards from the junction of the first contact arm and the biasing arm.

3. The flexible circuit board connector of claim 1, wherein the second engaging portion projects downwards from the second contact arm to form a barb for being engaged with the retention wall so as to prevent the terminal from being disengaged in a direction of the insertion of the terminal.

4. A flexible circuit board connector, comprising:

a dielectric housing defining a mating end and a connecting end opposite to the mating end, a plurality of receiving slots formed in the dielectric housing and passing through the connecting end and the mating end;

a plurality of terminals mounted in the corresponding receiving slots from the connecting end to the mating end, each of the terminals comprising:

a first contact arm and a second contact arm disposed in opposition to the first contact arm, the first and second contact arms respectively having contact portions;

a biasing arm and a fixing arm respectively integrally connecting with ends of the first and second contact arms, the fixing arm having a fixing leg and a pivoting slot; and a linking arm disposed between and connected to a junction of the first contact arm and the biasing arm and a junction of the second contact arm and the fixing arm; and a pressing element rotatably supported by the dielectric housing, and pivoting on the pivoting slot against the biasing arm so as to tilt the first contact arm towards the second contact arm to clamp a flexible circuit board in place;

wherein each of the terminals comprises a first engaging portion formed on the junction of the first contact arm and the biasing arm and a second engaging portion formed on the junction of the second contact arm and the fixing arm, the first engaging portion and the second engaging portion are located in alignment with an axis of the linking arm, whereby the terminal is being jammed against the receiving slot by the first engaging portion and the second engaging portion so as to prevent the terminal from being disengaged in a direction of the insertion of the terminal;

wherein the first engaging portion is formed on and projects upwards from the junction of the first contact arm and the biasing arm for securing the terminal in the receiving slot, and the second engaging portion is formed opposite to the first engaging portion on and projects downwards from the junction of the second contact arm and the fixing arm for further securing the terminal in the receiving slot.

5. The flexible circuit board connector of claim 4, wherein the first engaging portion is integrally formed on and projects upwards from the junction of the first contact arm and the biasing arm.

6. The flexible circuit board connector of claim 4, wherein the second engaging portion projects downwards from the second contact arm to integrally form a barb for being interfered with an inner wall of the receiving slot.

* * * * *